US007721352B1

(12) United States Patent
Swift

(10) Patent No.: US 7,721,352 B1
(45) Date of Patent: May 25, 2010

(54) INFLATABLE WADER GARMENT ASSEMBLY

(76) Inventor: Douglas A. Swift, 11611 Millgrove Rd., Springboro, PA (US) 16435

( * ) Notice: Subject to any disclaimer, the term of this patent is extended or adjusted under 35 U.S.C. 154(b) by 0 days.

(21) Appl. No.: 12/402,121

(22) Filed: Mar. 11, 2009

(51) Int. Cl.
*A41D 13/12* (2006.01)

(52) U.S. Cl. ..... 2/82

(58) Field of Classification Search ..... 2/82, 2/227, 79, 81, 232, 242, 69, 272, 69.5, 456, 2/458

See application file for complete search history.

(56) References Cited

U.S. PATENT DOCUMENTS

| | | | | |
|---|---|---|---|---|
| 2,292,490 | A | 8/1942 | Stokes | |
| 2,869,152 | A | 1/1959 | Anderson | |
| 3,154,800 | A | 11/1964 | Anderson | |
| 3,465,375 | A | 9/1969 | Schell | |
| 3,500,485 | A | 3/1970 | Hillary | |
| D285,140 | S | 8/1986 | Ellenberger | |
| 5,393,254 | A * | 2/1995 | Ducheshe | 441/118 |
| 5,454,744 | A | 10/1995 | Seiler | |
| 6,206,744 | B1 | 3/2001 | Wigutow | |
| 6,463,593 | B2 * | 10/2002 | Cotten | 2/227 |
| 6,883,185 | B2 | 4/2005 | Duncan | |
| 2008/0076309 | A1 | 3/2008 | Sandrin et al. | |

* cited by examiner

*Primary Examiner*—Tejash Patel

(57) ABSTRACT

An inflatable wader garment assembly includes a lower body covering with a pair of leg coverings and a lower torso covering. The lower body covering has an upper edge including a front edge and a back edge. A bladder has a top wall, a bottom wall and a perimeter wall extending between the top and bottom walls. The bladder is U-shaped and has a central portion and a pair of legs. Each of the legs has a distal end with respect to the central portion. A tube is fluidly coupled to the bladder. Air may be blown through the tube to inflate the bladder. Front straps are coupled to the distal ends and to the front edge. At least one rear strap is attached to the central portion and is attached to the back edge.

6 Claims, 4 Drawing Sheets

INFLATABLE WADER GARMENT ASSEMBLY

BACKGROUND OF THE DISCLOSURE

Field of the Disclosure

The disclosure relates to wader devices and more particularly pertains to a new wader device for keeping a person afloat in deep water.

SUMMARY OF THE DISCLOSURE

An embodiment of the disclosure meets the needs presented above by generally comprising a lower body covering that includes a pair of leg coverings and a lower torso covering. The leg coverings each have a bottom end comprising a foot covering. The lower body covering has an upper edge forming an opening into the lower body covering. The upper edge includes a front edge and a back edge. A bladder has a top wall, a bottom wall and a perimeter wall extending between the top and bottom walls. The bladder is U-shaped and has a central portion and a pair of legs extending away from the central portion. Each of the legs has a distal end with respect to the central portion. A tube is fluidly coupled to the bladder. Air may be blown through the tube and into the bladder to inflate the bladder. A pair of front straps is provided. Each of the distal ends has one of the front straps attached thereto. Each of the front straps is attached to the front edge. At least one rear strap is attached to the central portion and is attached to the back edge.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
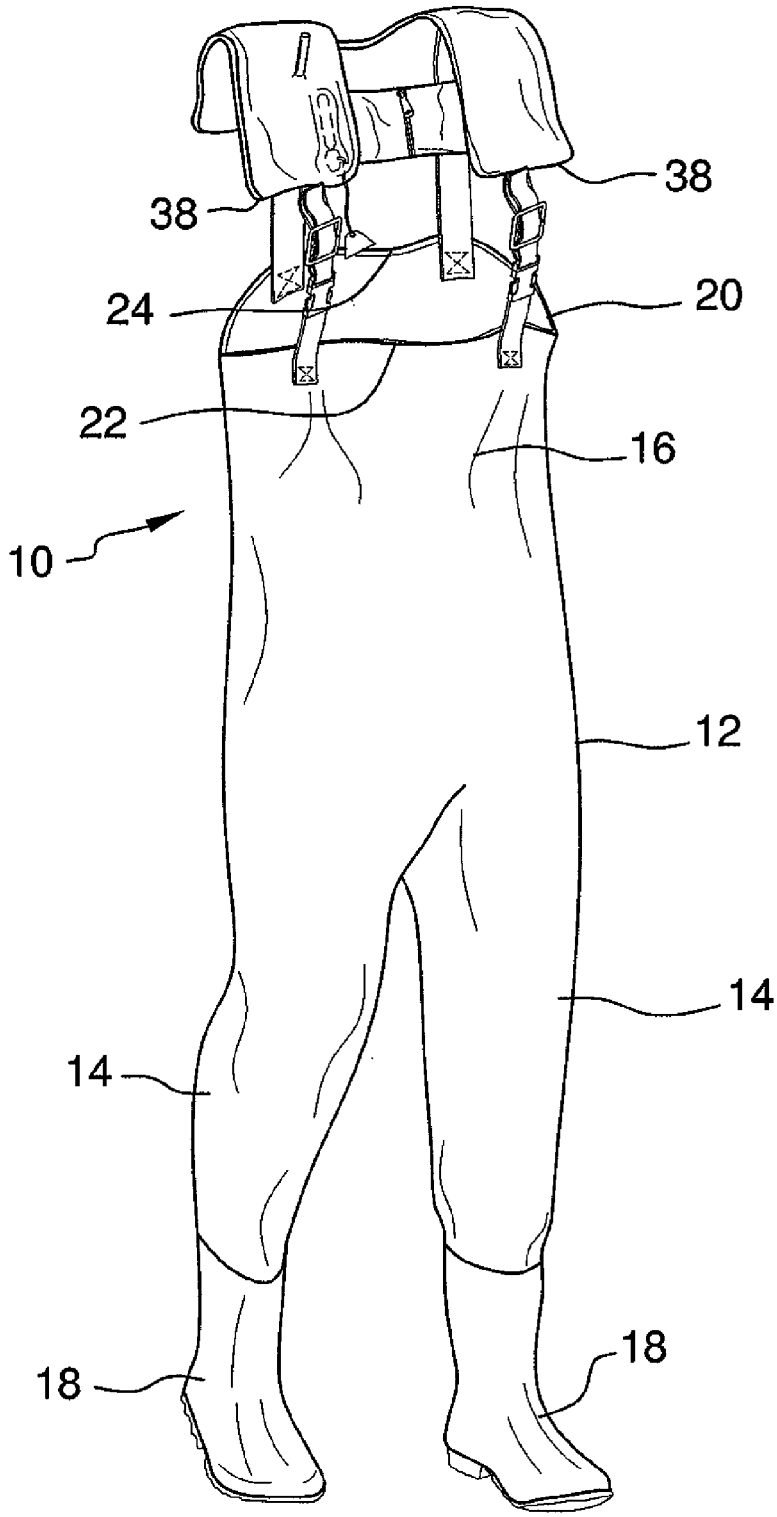
FIG. 1 is a front perspective view of a inflatable wader garment assembly according to an embodiment of the disclosure.

With reference now to the drawings, and in particular to FIGS. 1 through 4 thereof, a new wader device embodying the principles and concepts of an embodiment of the disclosure and generally designated by the reference numeral 10 will be described.

As best illustrated in FIGS. 1 through 4, the inflatable wader garment assembly 10 generally comprises a lower body covering 12 that includes a pair of leg coverings 14 and a lower torso covering 16. The leg coverings 14 each have a bottom end comprising a foot covering 18. The lower body covering 12 has an upper edge 20 forming an opening into the lower body covering 12. The upper edge 20 includes a front edge 22 and a back edge 24. The lower body covering 12 comprises a water impermeable material.

A bladder 26 has a top wall 28, a bottom wall 30 and a perimeter wall 32 extending between the top 28 and bottom walls 30. The bladder 26 is U-shaped and has a central portion 34 and a pair of legs 36 extending away from the central portion 34. Each of the legs 36 has a distal end 38 with respect to the central portion 34.

A tube 40 is fluidly coupled to the bladder 26. Air may be blown through the tube 40 and into the bladder 26 to inflate the bladder 26. A conventional one-way valve, not shown, may be positioned within the tube 40 to prevent air from exiting the tube 40 after it has been blown into the bladder 26.

Figure 2:
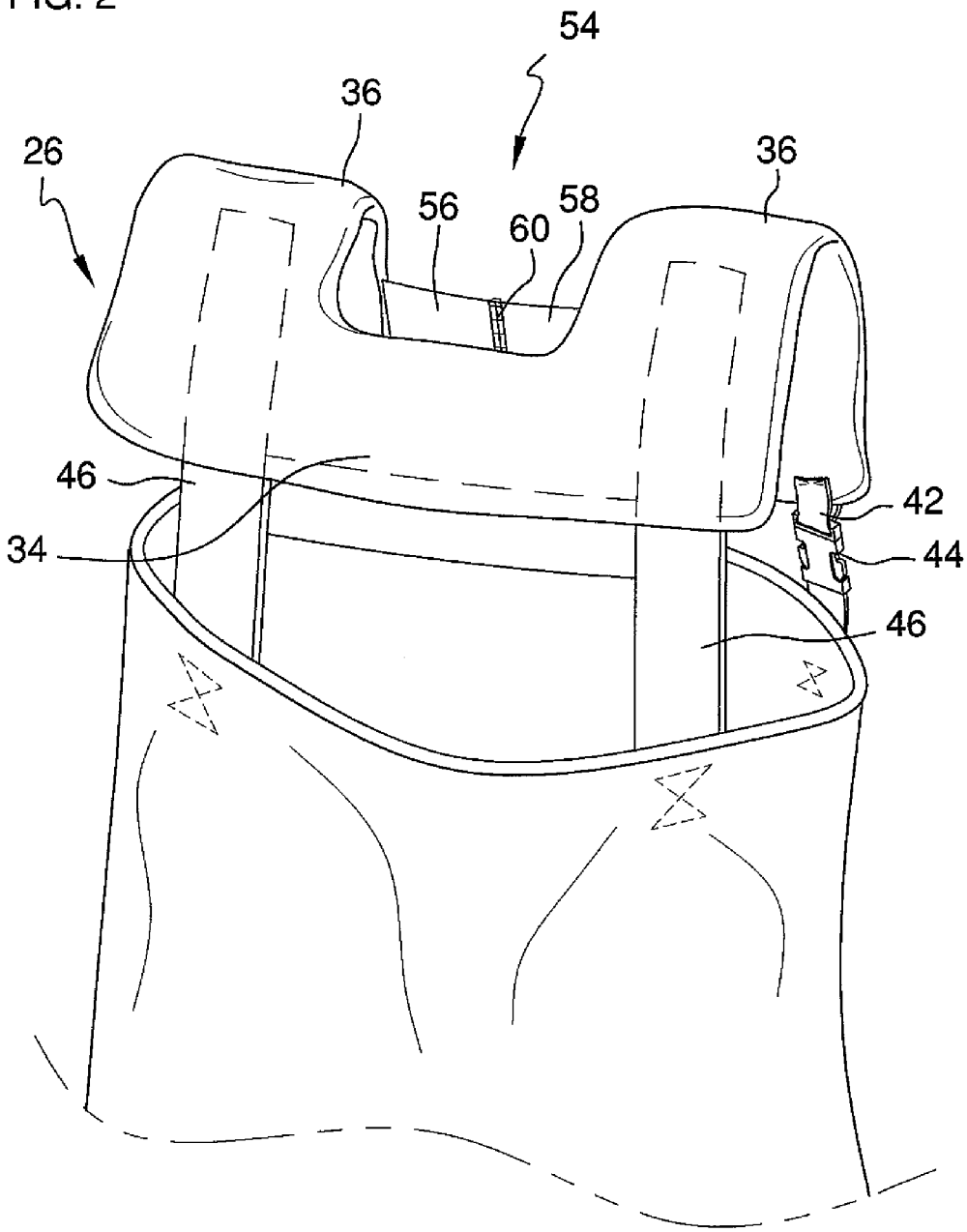
FIG. 2 is an enlarged front perspective view of an embodiment of the disclosure.
Figure 3:
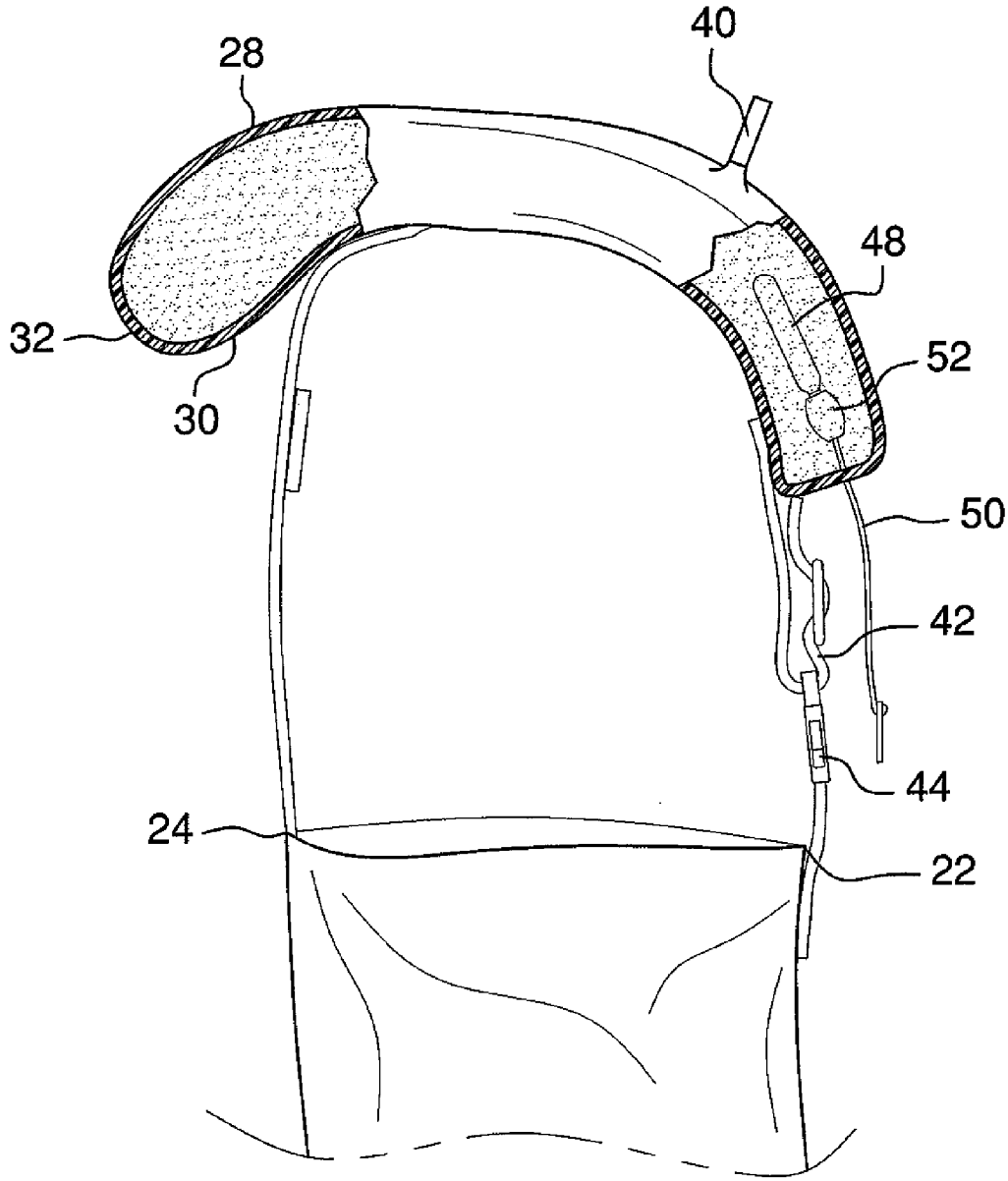
FIG. 3 is a side broken view of an embodiment of the disclosure.
Figure 4:
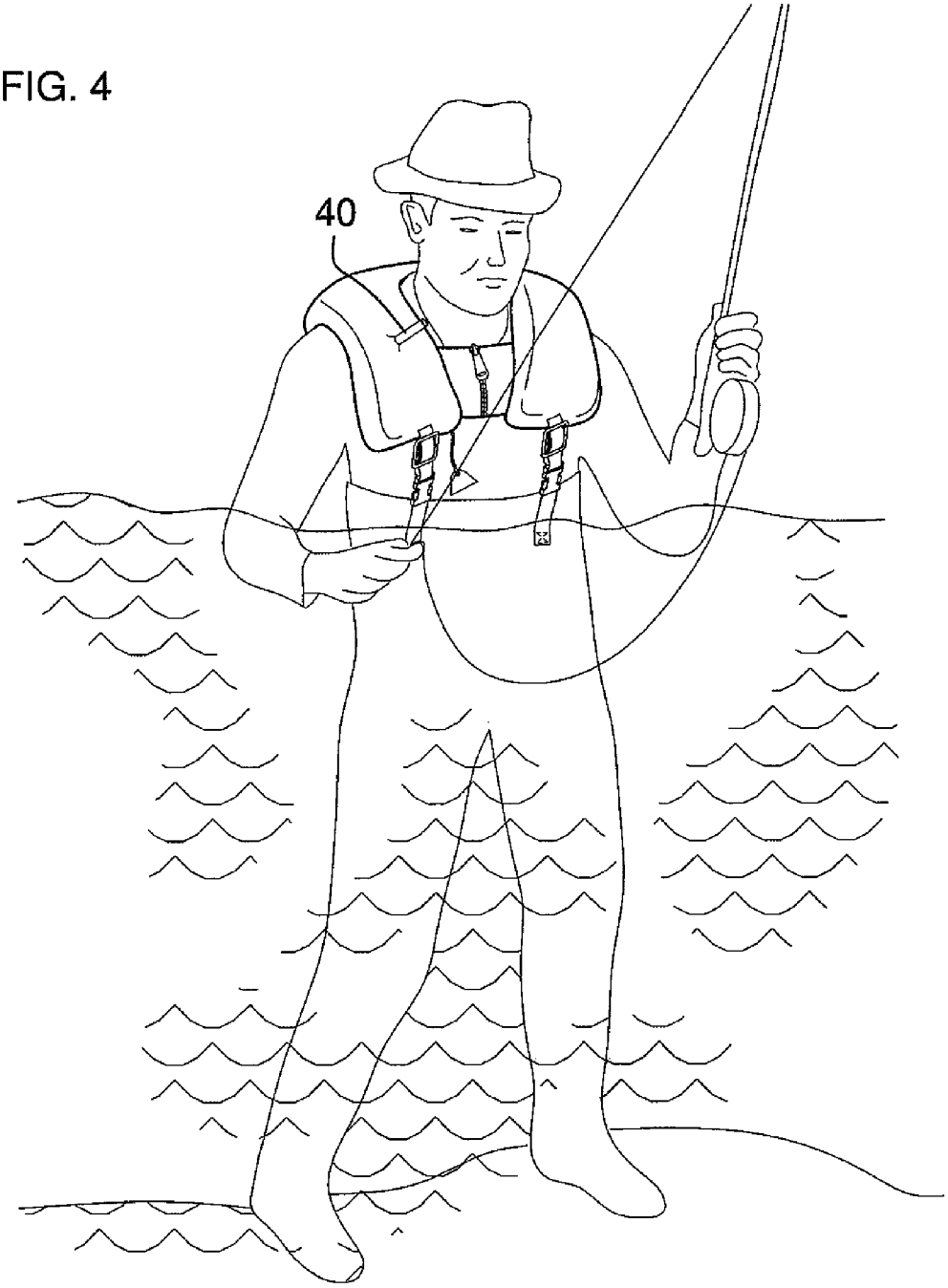
FIG. 4 is a front perspective in-use view of an embodiment of the disclosure.

A pair of front straps 42 is provided. Each of the distal ends 38 has one of the front straps 42 attached thereto. The front straps 42 are each attached to the front edge 22. This should be understood to include the straps being attached to the lower body covering 12 adjacent to the front edge 22. The front straps 42 each have an adjustable length. The front straps 42 may each also include a buckle 44 to releasably couple the front straps 42 from the front edge 22. At least one rear strap 46 is attached to the central portion 34 and is attached to the back edge 24 though more than one rear strap 46 may be used as shown in FIG. 2.

An air canister 48 having compressed air therein is positioned within the bladder 26. The compressed air may comprise $CO_2$. An actuator 50 of the air canister 48 extends through the bladder 26. The actuator 50 is actuated to release the compressed air from the canister 48 to inflate the bladder 26. The actuator 50 may comprise a cord coupled to a release valve 52 of the air canister 48.

A flexible panel 54 is attached to and extends between the legs 36. The panel 54 is positioned adjacent to the distal ends 38 and is spaced from the central portion 34. The panel 54 has a break therein to define first 56 and second 58 sections of the panel 54. A zipper 60 releasably couples together the first 56 and second 58 sections.

In use, the lower body covering 12 is worn as conventional waders. However, the bladder 26 may be inflated to prevent the drowning of a person wearing the assembly 10. The air canister 48 may be used in an emergency situation where the bladder 26 has not been previously inflated, for comfort reasons, but the wearer suddenly finds themselves in a situation where they are in too deep of water.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A wader garment assembly including:

a lower body covering including a pair of leg coverings and a lower torso covering, said leg coverings each having a bottom end comprising a foot covering, said lower body covering having an upper edge forming an opening into said lower body covering, said upper edge including a front edge and a back edge;

a bladder having a top wall, a bottom wall and a perimeter wall extending between said top and bottom walls, said bladder being U-shaped and having a central portion and a pair of legs extending away from said central portion, each of said legs having a distal end with respect to said central portion;

a tube being fluidly coupled to said bladder, wherein air may be blown through said tube and into said bladder to inflate said bladder;

a pair of front straps, each of said distal ends having one of said front straps attached thereto, each of said front straps being attached to said front edge;

at least one rear strap being attached to said central portion and being attached to said back edge; and a flexible panel being attached to and extending between said legs, said panel being positioned adjacent to said distal ends and being spaced from said central portion, said panel having a break therein to define first and second sections of said panel, a zipper releasably coupling together said first and second sections.

2. The assembly according to claim 1, wherein said lower body covering comprises a water impermeable material.

3. The assembly according to claim 1, wherein said front straps each have an adjustable length.

4. The assembly according to claim 3, wherein each of said front straps includes a buckle to releasably couple said front straps from said front edge.

5. The assembly according to claim 1, further including an air canister having compressed air therein being positioned within said bladder, an actuator of said air canister extending through said bladder, said actuator being actuated to release the compressed air from said canister to inflate said bladder.

6. A wader garment assembly including:

a lower body covering including a pair of leg coverings and a lower torso covering, said leg coverings each having a bottom end comprising a foot covering, said lower body covering having an upper edge forming an opening into said lower body covering, said upper edge including a front edge and a back edge, said lower body covering comprising a water impermeable material;

a bladder having a top wall, a bottom wall and a perimeter wall extending between said top and bottom walls, said bladder being U-shaped and having a central portion and a pair of legs extending away from said central portion, each of said legs having a distal end with respect to said central portion;

a tube being fluidly coupled to said bladder, wherein air may be blown through said tube and into said bladder to inflate said bladder;

a pair of front straps, each of said distal ends having one of said front straps attached thereto, each of said front straps being attached to said front edge, said front straps each having an adjustable length, each of said front straps including a buckle to releasably couple said front straps from said front edge;

at least one rear strap being attached to said central portion and being attached to said back edge;

an air canister having compressed air therein being positioned within said bladder, an actuator of said air canister extending through said bladder, said actuator being actuated to release the compressed air from said canister to inflate said bladder; and a flexible panel being attached to and extending between said legs, said panel being positioned adjacent to said distal ends and being spaced from said central portion, said panel having a break therein to define first and second sections of said panel, a zipper releasably coupling together said first and second sections.

* * * * *